United States Patent [19]

Moe et al.

[11] 4,227,339

[45] Oct. 14, 1980

[54] TOY ANIMAL

[75] Inventors: Walter Moe, Los Angeles, Calif.; Charles M. Diker, New York, N.Y.; Harley Wolf, Studio City, Calif.

[73] Assignee: Diker Moe Associates, West Los Angeles, Calif.

[21] Appl. No.: 8,436

[22] Filed: Feb. 1, 1979

[51] Int. Cl.[3] ..... A63H 11/00

[52] U.S. Cl. ..... 46/123; 46/145

[58] Field of Search ..... 46/123, 145, 124, 146, 46/127, 47, 115, 116; 273/108

[56] References Cited

U.S. PATENT DOCUMENTS

| | | | |
|---|---|---|---|
| 2,611,997 | 9/1952 | Solloway et al. | 46/123 |
| 2,674,457 | 4/1954 | Rago | 46/145 X |
| 3,997,157 | 12/1976 | Meyer | 46/127 X |

*Primary Examiner*—Robert Peshock
*Assistant Examiner*—Mickey Yu

[57] ABSTRACT

A toy having a generally-cylindrical body with apertures about the circumference of the body at preselected intervals, objects positioned in the apertures on the surface of the body, and a tail which may be rotated. Rotation of the tail drives an interior drum which impels the objects from the apertures.

3 Claims, 3 Drawing Figures

TOY ANIMAL

BACKGROUND OF THE INVENTION

The background of the invention will be discussed in two parts:

Field of the Invention

This invention relates to toys and, more particularly, to toys which may be operated by preschool children.

Description of the Prior Art

There have been a myriad of toys developed over the years for use by children of all ages. Many of these toys have become classics and have been reproduced again and again. On the other hand, most toys lack sufficient play value to entice children over any long period of time and after a short spurt of popularity fall into disuse and disappear from the market.

Toys for preschool children pose an especial problem because they must be limited to physical actions which can be accomplished by such young children yet be sufficiently entertaining to maintain their attention. Unsuccessful prior art toys require complicated movements which preschool children are unable to perform and offer very little emotional stimulation. The successful ones of such toys provide an exciting learning experience for a child during an especially important formative period of its life.

Toys which are manufactured for preschool children should, because of the relatively short period of time in which they are to be used, be inexpensive. On the other hand, because preschool children tend to be quite destructive, their toys should be quite sturdy. Meeting these two criteria at the same time has posed a problem for many prior art toys.

It is an object of the present invention to provide a new and improved toy for a preschool child;

It is another object of the present invention to provide a sturdy, inexpensive toy for a preschool child;

It is still another object of the present invention to provide a new and improved toy animal for a preschool child which may be operated to provide realistic entertaining action.

SUMMARY OF THE INVENTION

The foregoing and other objects of the invention are accomplished by a toy which may, in a preferred embodiment, be an animal having a central generally-cylindrical body portion, four legs supporting the body portion, a head, and a tail. Apertures are provided in the body portion to receive a number of appendages attached to objects which are to rest on the body, in one case—toy fleas. Rotating the tail causes a drum positioned in the generally-cylindrical body portion to rotate causing means positioned on the drum to impel the objects individually from the body of the animal.

Other objects, features, and advantages of the invention will become apparent from a reading of the specification taken in conjuncion with the drawings in which like reference numerals refer to like elements in the several views.

DESCRIPTION OF THE PREFERRED EMBODIMENT

Figure 1:
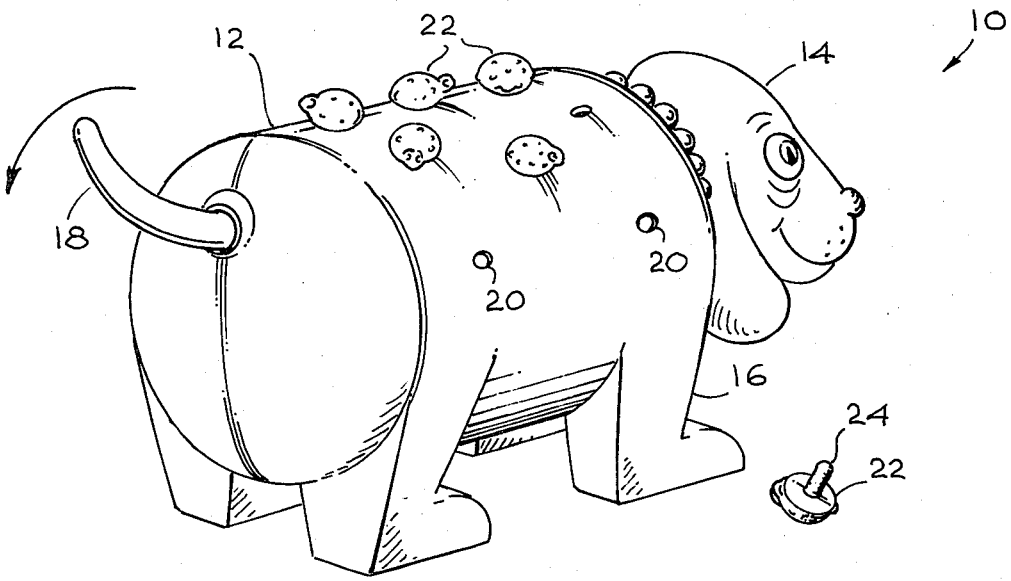
FIG. 1 is a perspective view of a toy constructed in accordance with the invention.

Referring now to the drawings and, more particularly, to FIG. 1, there is shown in perspective view a toy animal 10 constructed in accordance with the invention. The animal 10 (a dog in this embodiment) includes a central body portion 12 of generally-cylindrical, barrel-like shape; a head 14; four legs 16; and a tail 18. Positioned about the circumference of the central body 12 are a number of apertures 20 which, in the particular embodiment, fall on a number of circular paths lying in planes at right angles to the cylindrical axis of the body portion. A number of objects 22 (toy fleas in this embodiment) are positioned in selected ones of the apertures 20. Each of the objects 22 has protruding therefrom on its underside an appendage or stem 24 which in positioning the object 22 protrudes through the aperture 20 into the internal portion of the body 12. The position of objects 22 may be better understood from FIG. 3 which shows a partially cut-away side view of an object 22 protruding through the shell of the body 12 into the interior thereof.

The entire body portion 12, the legs 16, the tail 18, the head 14 of the toy 10, and the objects 22 may all be constructed of a material such as a plastic which may be easily molded by well-known construction techniques into a form to give the appearance of a dog or other animal with fleas on its back.

Figure 2:
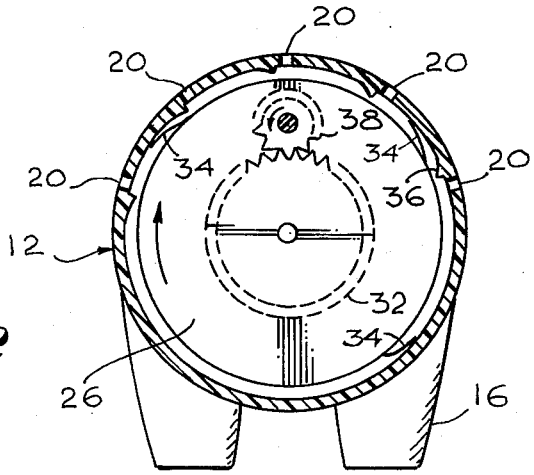
FIG. 2 is a cut-away cross-sectional view of the toy shown in FIG. 1.

Mounted within the central body portion 12 is a cylindrical drum 26 mounted at its two ends to rotate upon its axis by rods 28 positioned in bearings 30 molded into the end walls of the toy 10. The drum 26 also has coaxially-mounted at one end a driving gear 32. the drum 26 mounts about its periphery a number of spring members 34 which may be urged upwardly to ride against the interior of the body portion 12 and may be better seen in FIG. 2. The springing action of the elements 34 may be obtained in a number of ways including molding them into the original drum 26 in such a manner that they project outwardly beyond the inner surface of the central body 12 in their relaxed condition but must be urged inwardly during manufacture to place the drum 26 within the body portion 12.

Figure 3:
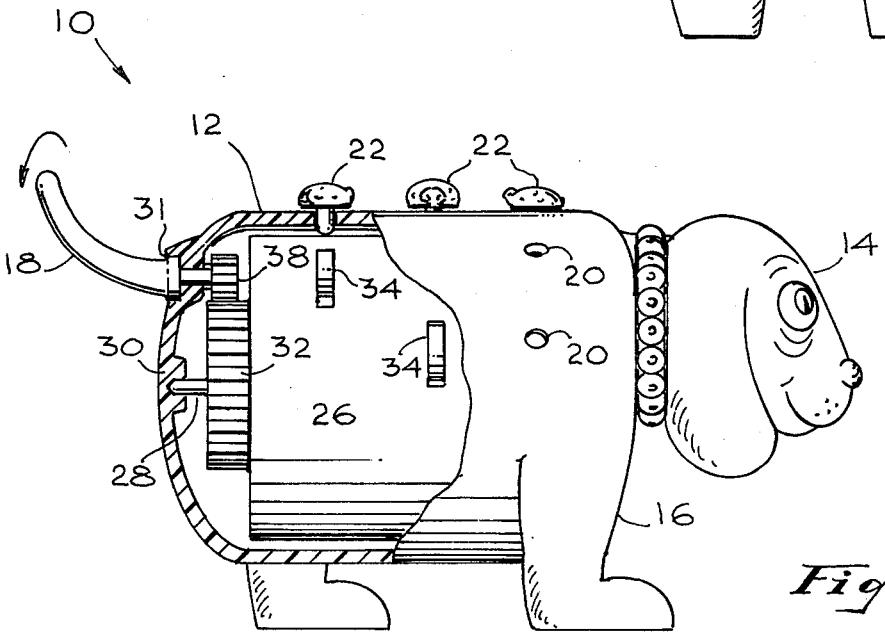
FIG. 3 is a partially cut-away side view of the toy shown in FIG. 1.

As will be noted from FIG. 3 each of the springs 34 is mounted so that it will move in a circular path so as to come in contact with all of the apertures 20 which are similarly aligned. If an object 22 is positioned in an aperture 20 lying in the path of a particular spring 34, it will be contacted by the spring. The interior of the body 12 may be provided with means such as ramp members 36 molded into the inner surface to deflect the springs 34 urging them inwardly as they pass over the ramp members 36 and releasing them to spring against the inner surface of the body 12 after they have passed by. This release will cause the object 22 to spring from the outer surface of the body portion 12.

As may be seen in FIG. 3, the tail 18 is mounted to rotate in a bearing 31 formed in the end shell of the toy 10 and to drive a gear 38. The gear 38 rotates against the gear 32 thereby causing the gear 32 to rotate the drum 26 affixed to it. Means such as a rachet, not shown, may be provided within the body 12 to assure that the drum 26 moves only in one direction. Thus, when the tail 18 is rotated and the drum 26 moves as shown by the arrows in FIG. 2, the springs 34 pass by the ramps 36, are compressed by the ramps 36, and spring upwardly against the interior of the body 12 at each of the apertures 20. If an object 22 is positioned in an aperture 20, the spring 34 will cause it to be impelled from the body of the animal 10. To a child, it will appear as though toy fleas are being thrown from the body of the animal 10 as the tail 18 is rotated. Consequently, a great deal of action is provided by a simple rotating motion which may be accomplished by preschool children. Thus, the toy may be utilized by preschool children and should prove fascinating to them.

All of the elements of the toy may be molded of plastic materials which are relatively impervious to the wear normally caused by a preschool child. Consequently, the toy may be made quite inexpensively. It will prove to be relatively sturdy when used. Obviously, other materials and construction techniques could be used to provide an animal such as the animal 10 shown in this invention. There are any number of means by which objects may be caused to first adhere to a surface and later spring from the surface. For example, each of the objects 22 might be provided with a spring surrounding the appendage 24 which spring is compressed when the appendage 24 is placed in the aperture 20. A catch on the end of the appendage 24 might lock against the interior surface of the body 12 and be released by the rotation of the interior cylinder 26.

Furthermore, different animals and objects should obviously fall within the scope of the invention. For example, the body might emulate a hill and the objects might be flowers or toy children. Thus, while there has been shown and described a preferred embodiment, it is to be understood that various other adaptations and modifications may be made within the spirit and scope of the invention.

What is claimed is:

1. A toy comprising a generally-cylindrical hollow central portion having a number of apertures from its exterior to its interior, a cylinder mounted to rotate in the interior of the central portion, means for rotating the cylinder, a thing having a projecting appendage selected to extend through said apertures into the interior of the central portion, and means including a spring mounted to said cylinder for causing said thing to fly off of the exterior of the central portion.

2. A toy as claimed in claim 1 in which the thing resembles a bug.

3. A toy as claimed in claim 2 in which the means mounted to the cylinder further comprises ramps positioned on the interior of the central portion adjacent said apertures for placing tension on the spring and releasing it to strike against the appendage.

* * * * *